US012667173B2

(12) United States Patent
Serman

(10) Patent No.: US 12,667,173 B2
(45) Date of Patent: Jun. 30, 2026

(54) KIND OF CARD STORAGE BOX WITH SLIDE BAR STRUCTURE

(71) Applicant: Leonid Vitalievich Serman, North Highlands, CA (US)

(72) Inventor: Leonid Vitalievich Serman, North Highlands, CA (US)

( * ) Notice: Subject to any disclaimer, the term of this patent is extended or adjusted under 35 U.S.C. 154(b) by 264 days.

(21) Appl. No.: 18/446,896

(22) Filed: Aug. 9, 2023

(65) Prior Publication Data

US 2025/0049185 A1 Feb. 13, 2025

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/147
See application file for complete search history.

(56) References Cited

U.S. PATENT DOCUMENTS

| | | | | |
|---|---|---|---|---|
| 10,653,222 | B2 * | 5/2020 | Scharnigg | B65D 83/08 |
| 11,311,086 | B2 * | 4/2022 | Van Geer | A45C 11/182 |
| 11,344,091 | B2 * | 5/2022 | Goodwin | A45C 13/1069 |
| 2009/0101255 | A1 * | 4/2009 | Long | A45C 11/182 150/147 |
| 2019/0365066 | A1 * | 12/2019 | Hill | A45C 11/182 |

* cited by examiner

*Primary Examiner* — Sue A Weaver

(57) ABSTRACT

A kind of card storage box with slide bar structure involves the technical field of card storage equipment. The knockout plate is movably connected with the casing, the baseplate is connected with the casing by screw, and there is slide bar assembly on the lateral wall of the casing, the slide bar assembly includes slide block, slide bar and spring, the slide bar penetrates the slide block, the spring is belled on one end on the slide bar for butting with the slide block, and the other end of it is butted with the casing, there is locating slot on the lateral side of the knockout plate, so that it is interlocked with the slide block, there is push rod on the baseplate, the engagement of slide block with slide bar and spring is adopted, so as to provide restoring force for the knockout plate.

10 Claims, 12 Drawing Sheets

KIND OF CARD STORAGE BOX WITH SLIDE BAR STRUCTURE

TECHNICAL FIELD

This industrial new design involves a kind of card storage box with slide bar structure, and it involves the technical field of card storage equipment.

BACKGROUND ART

Bank card and visiting card are daily used by people, and card bag or card box is usually needed for storage, so as to facilitate using by people.

To facilitate fetching and using of cards, existing card storage equipment elastic knockout structure or pressing structure is mostly adopted in existing card storage equipment, so as to push out card from storage box for fetching and using, for the storage equipment that adopts spring as the resetting part and matches with the knockout structure, single or multiple stalks of spring(s) is (are) usually set at the bottom part of the knockout structure, but because of the direct effect of stretching spring, the spring hook at top is prone to deformation and detaching after long time of use, and the feel of stretching is poor when using, for example, in the proprietary technology publicized by publication number CN210881413U, a kind of card box performs resetting through the spring at one side, because of force at single side, relatively big friction occurs between the push rod and casing, and the circumstance of jamming is prone to emergence to affect the using experience, but in the proprietary technology of publication number CN219028970U, a kind of card box that adopts lever pressing structure is publicized, the hound rod drives the carrying bar to push out card, so as to avoid the problem of jamming in traditional elastic component, but since lever principle is adopted, relatively big force is used for pressing in using, the pressing is conducted from lateral side and it lacks resetting structure, the feel of using is poor.

CONTENT OF INDUSTRIAL NEW DESIGN

Aimed at the defect or shortcoming in existing technology, this industrial new design is to provide a kind of card knockout box with slide bar structure, the matching of slide block and slide bar and spring is adopted, so as to provide restoring force for the knockout plate, so that cards can be easily pushed out in layers, the feel of knockout and resetting is both comparatively good, and the experience of using is improved.

In order to realize the above purpose, the technical scheme adopted for this industrial new design is: it includes knockout plate 1, casing 2 and baseplate 3, the knockout plate 1 and casing 2 are movably connected, the baseplate 3 and casing 2 are connected by screw, there is slide bar assembly 4 on the lateral wall of the said casing 2, the slide bar assembly 4 includes slide block 4-1, slide bar 4-2 and spring 4-3, the slide bar 4-2 penetrates the slide block 4-1, the spring 4-3 is belled on one end on the slide bar 4-2 for butting with the slide block 4-1, and the other end of it is butted with the casing 2, there is locating slot 1-1 at the lateral part of the said knockout plate 1 for interlocking with the slide block 4-1, and there is push rod 5 on the said baseplate 3.

Furthermore, the said casing 2 includes lateral arm 2-1 and bottom case 2-2, there are two lateral arms 2-1, which (2-1) compose a U shaped opening structure together with the bottom case 2-2.

Furthermore, there is sliding-groove 2-1-1 at the middle upper part of the said lateral arm 2-1, so as to match with the slide bar assembly 4.

Furthermore, there is opening upper fixed groove 2-1-3 at top of the said sliding-groove 2-1-1, and there is opening lower fixed groove 2-1-4 at the bottom end of the sliding-groove 2-1-1.

Furthermore, the there is non-skid block slot 2-1-2 at top of the said lateral arm 2-1, there is fixed block 2-3 in the non-skid block slot 2-1-2, and the non-skid block 6 is interlocked on the fixed block 2-3.

Furthermore, at the connected part of the said lateral arm 2-1 and the knockout plate 1, there is knockout plate slot 2-1-5.

Furthermore, the said knockout plate 1 bilaterally extend outward to form the concatenated board 1-2, which (1-2) matches with the knockout plate slot 2-1-5.

Furthermore, there is positive stop 2-2-1 at the middle part of the said bottom case 2-2, there is gap at that side of the positive stop 2-2-1 close to the knockout plate 1, the bottom part of the bottom case 2-2 is connected with a clamp piece 10 by screw, and the clamp piece 10 contacts the baseplate 3 after bending upward.

Furthermore, there is a segment of rake face 5-1 on that side of the said push rod 5 which is faced with the knockout plate 1, there is push groove 5-2 on the rake face 5-1, there is axle hole at the end part of the push rod 5, and it is movably connected with the fixed axle at one end on bottom of the baseplate 3.

Furthermore, there is push column 7 at the bottom center of the said knockout plate 1.

The operational principle of this industrial new design: a the time of assembling, firstly let the slide bar 4-2 penetrate into the slide block 4-1, then let the spring 4-3 cover onto the slide bar 4-2, let that end 4-3 without spring insert into the lower fixed slot 2-1-4, and let that end 4-3 with spring insert into the upper fixed slot 2-1-3, so as to finish the assembling of slide bar assembly 4, then let the knockout plate 1 insert along the knockout plate slot 2-1-5, so that the locating slot 1-1 engages with the slide block 4-1, the knockout plate 1 butted with the bottom case 2-2, then install the push rod 5 onto the baseplate 3, which (3) fully covers the casing 2, and align the push groove 5-2 with the push column 7, so that integral installation is finished after screws are locked, at the time of using, let the knockout plate 1 slide upward to drive the slide block 4-1 go up to compress the spring 4-3, when the knockout plate 1 goes up, the push column 7 slides in the push groove 5-2, so as to drive the push rod 5 to rotate, under the effect of rake face 5-1, the cards in it are pushed out in layers, and since the non-skid block 6 clamps card, card would not retreat after being pushed out, release the knockout plate 1, it would return to the original position under the acting force of spring 4-3 that pushes the slide block 4-1, so that the needed card can be fetched conveniently, and the card can be pressed back after fetching.

BRIEF DESCRIPTION OF ACCOMPANY DRAWINGS

In order to more clearly explain the technical scheme in the example of this industrial new design or the existing technology, the patent drawing that needs to be used in the example or existing technical description is now briefly introduced, and the patent drawings in the following description are obviously are only some examples of this industrial new design, for ordinary technical personnel of this field, on the prerequisite of not performing creative labor, other patent drawings can also be obtained from those patent drawings.

Figure 1:
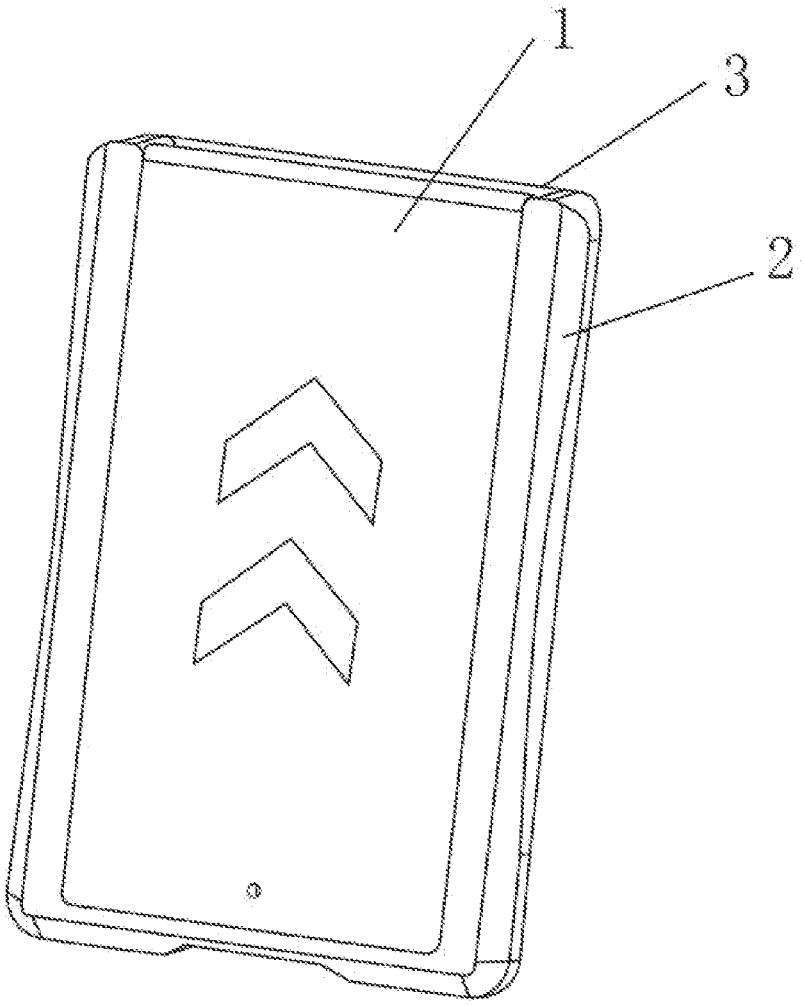
FIG. 1 is the structural schematic diagram of this industrial new design.
Figure 2:
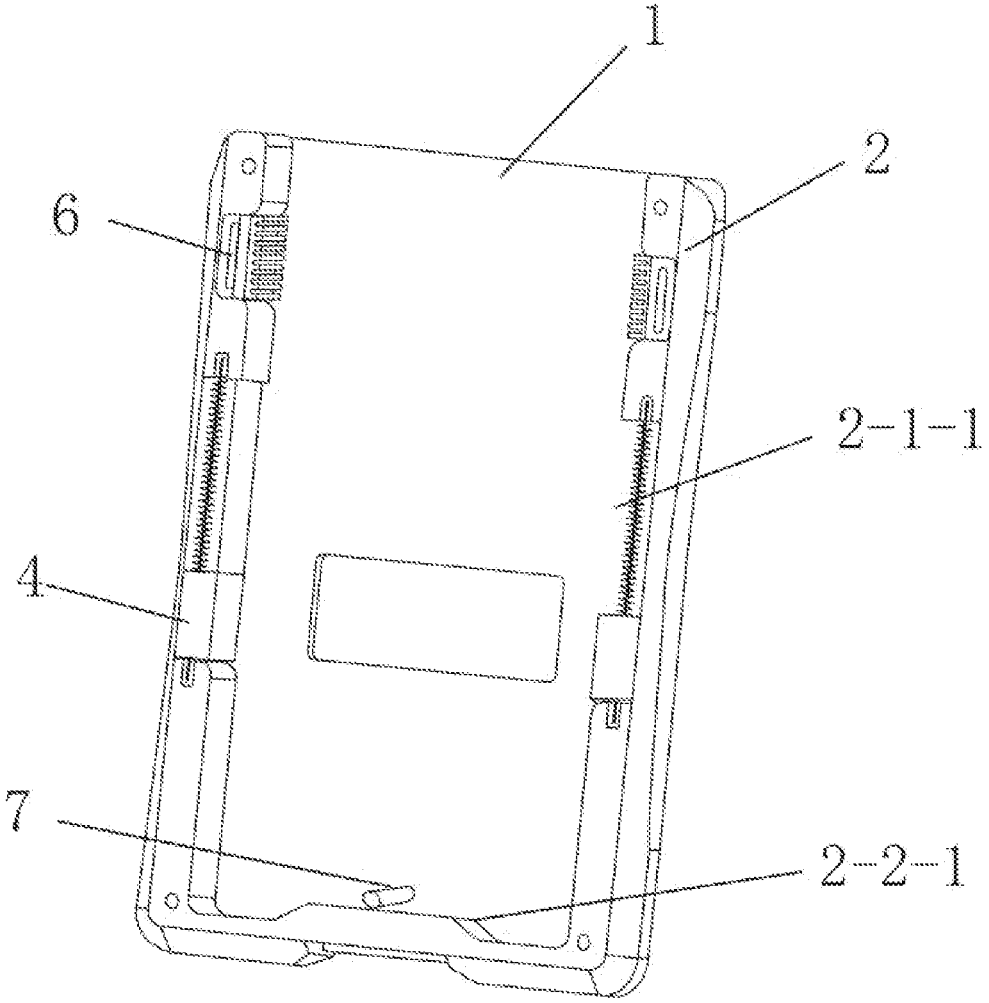
FIG. 2 is the structural schematic diagram of this industrial new design that excludes the baseplate 3.
Figure 3:
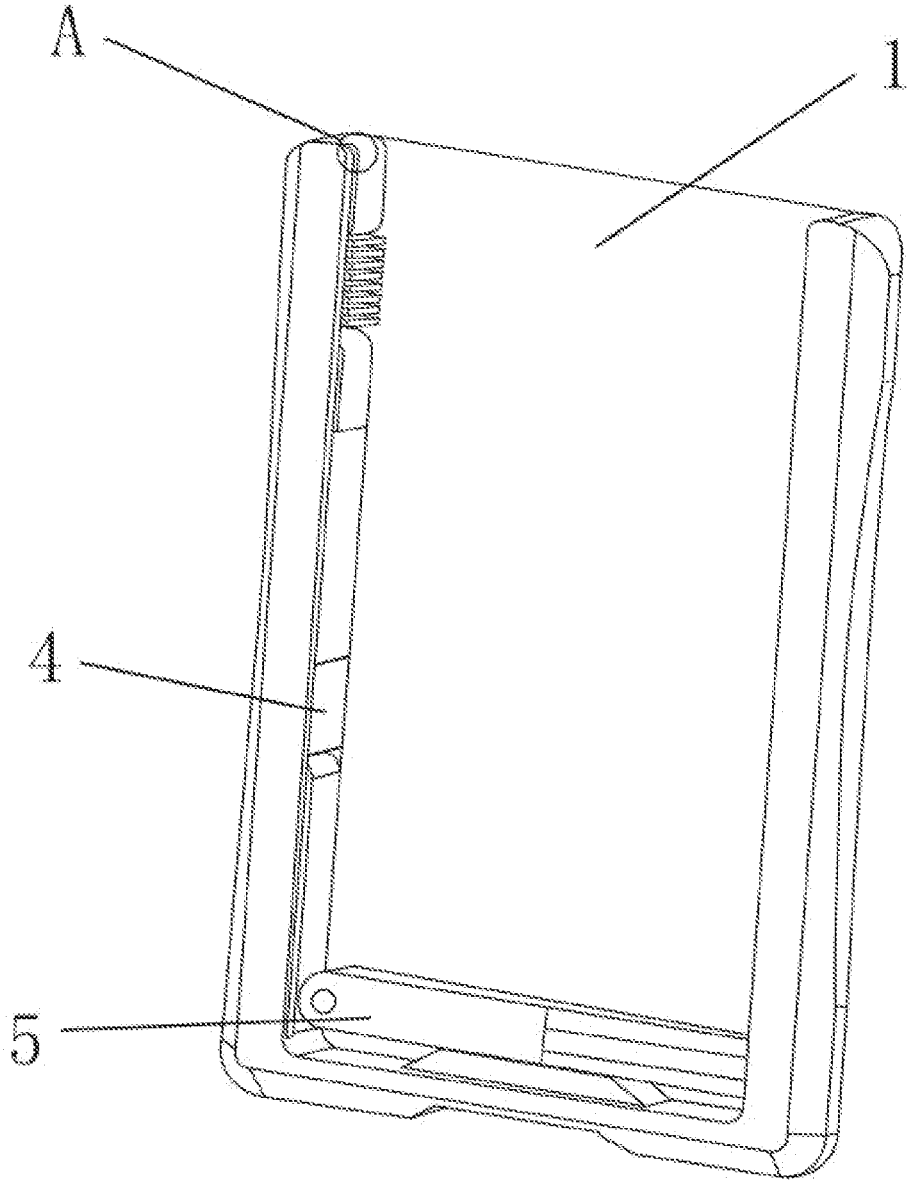
FIG. 3 is the structural schematic diagram of this industrial new design that excludes the knockout plate 1.
Figure 4:
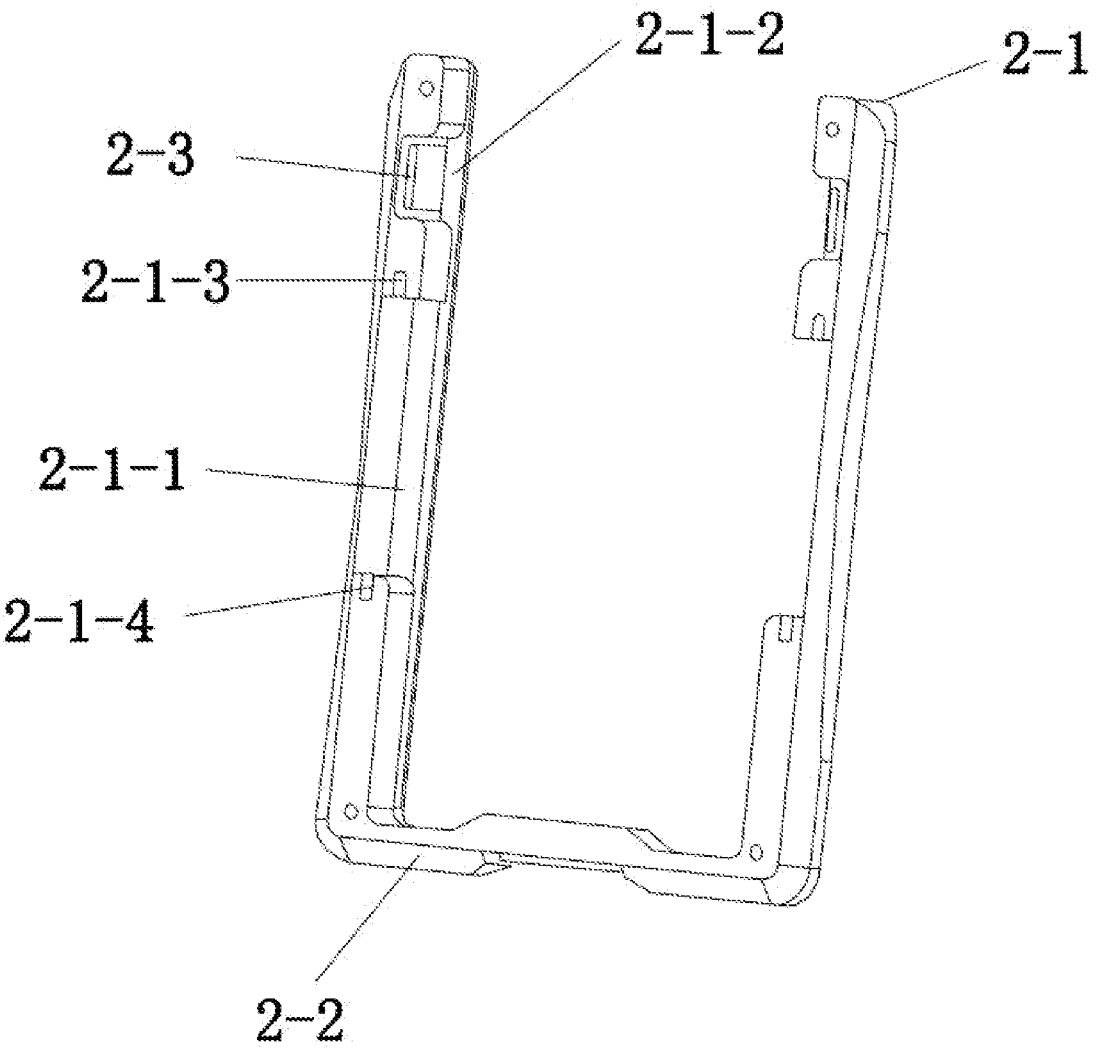
FIG. 4 is the structural schematic diagram of the casing 2 in this industrial new design.
Figure 5:
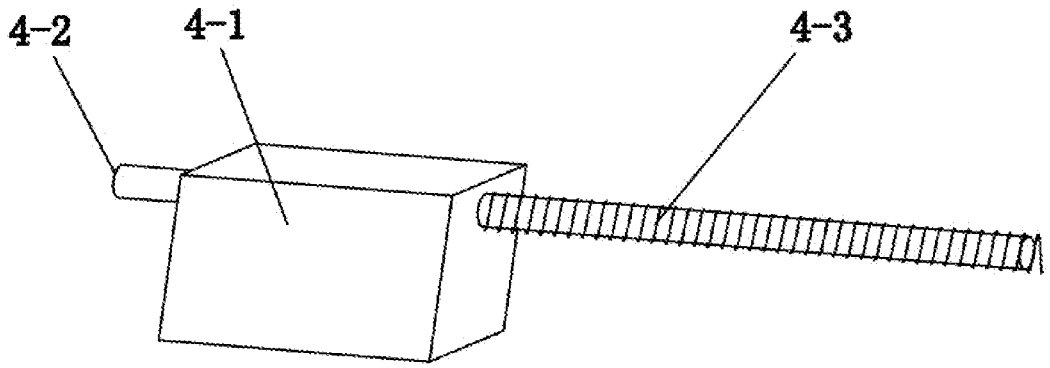
FIG. 5 is the structural schematic diagram of the slide bar assembly 4 in this industrial new design.
Figure 6:
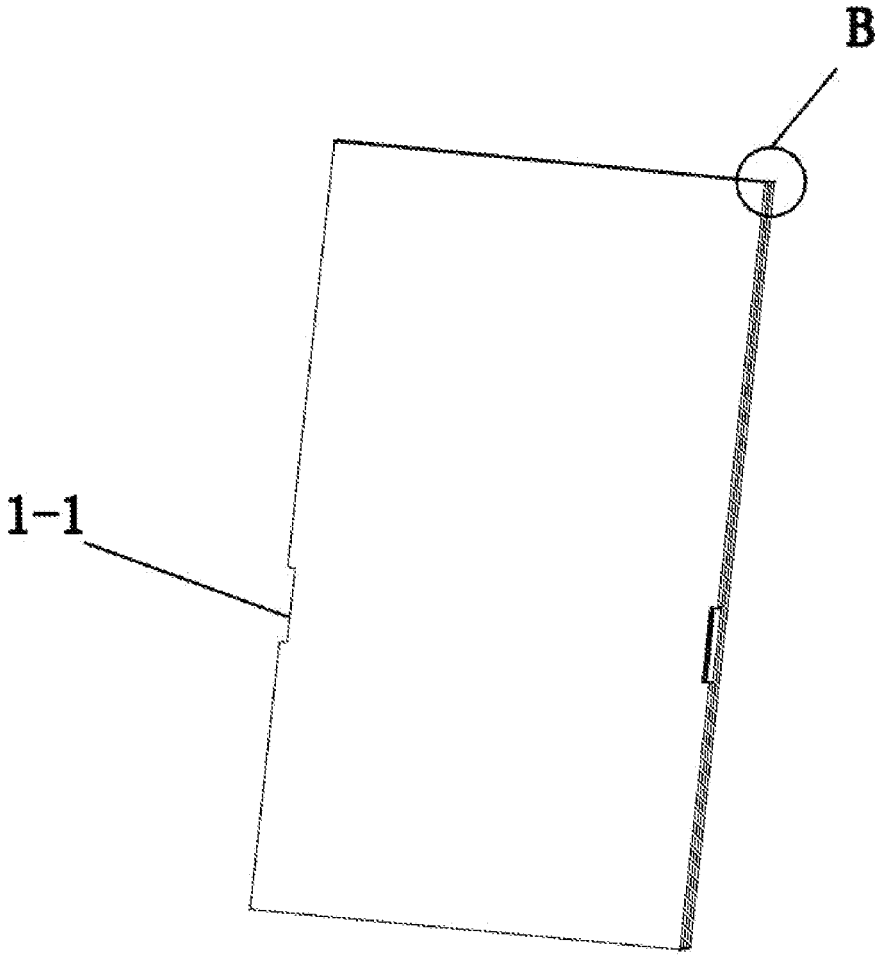
FIG. 6 is the structural schematic diagram of the knockout plate 1 in this industrial new design.
Figure 7:
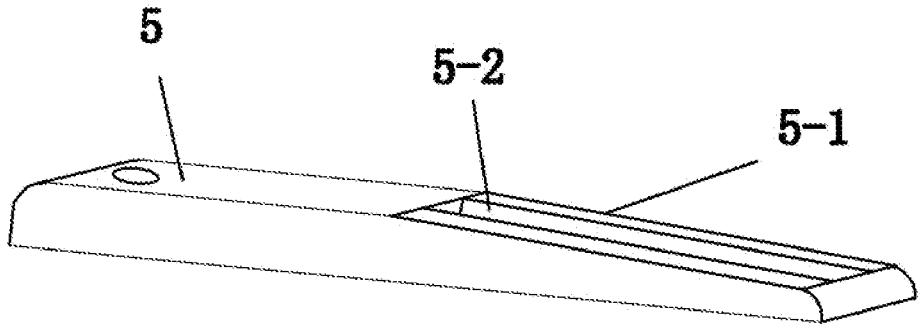
FIG. 7 is the structural schematic diagram of the push rod 5 in this industrial new design.
Figure 8:
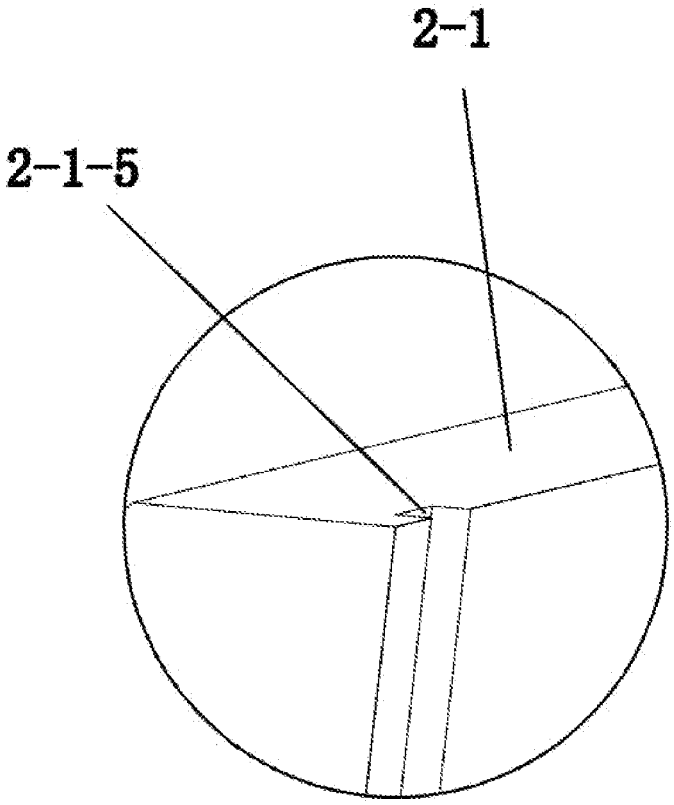
FIG. 8 is the enlarged structural schematic diagram of part A in FIG. 3.
Figure 9:
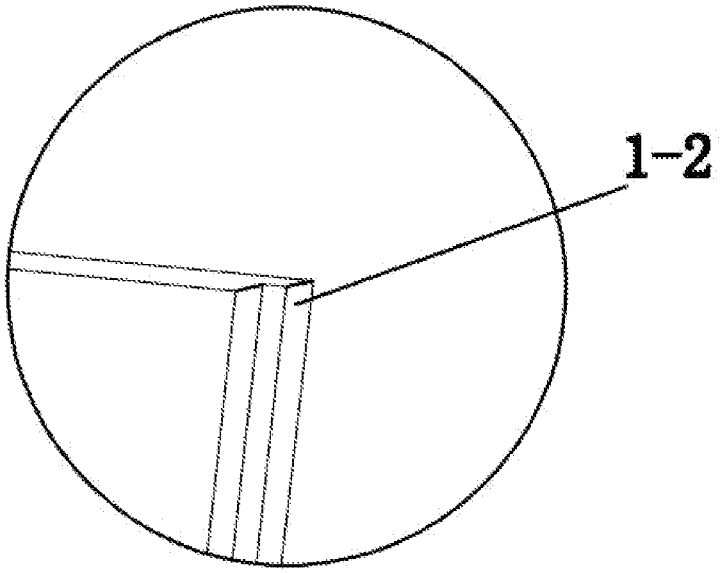
FIG. 9 is the enlarged structural schematic diagram of part B in FIG. 6.
Figure 10:
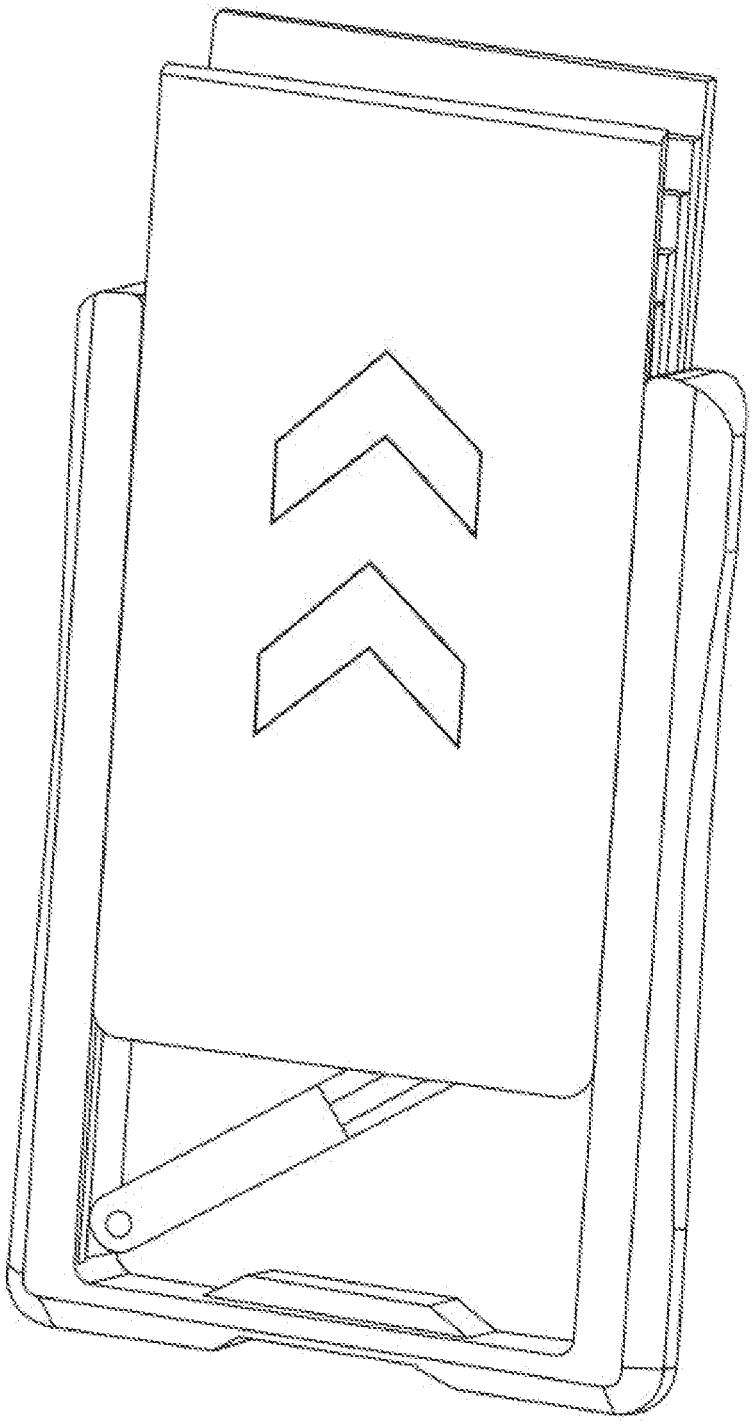
FIG. 10 is the schematic diagram for the using status of this industrial new design.
Figure 11:
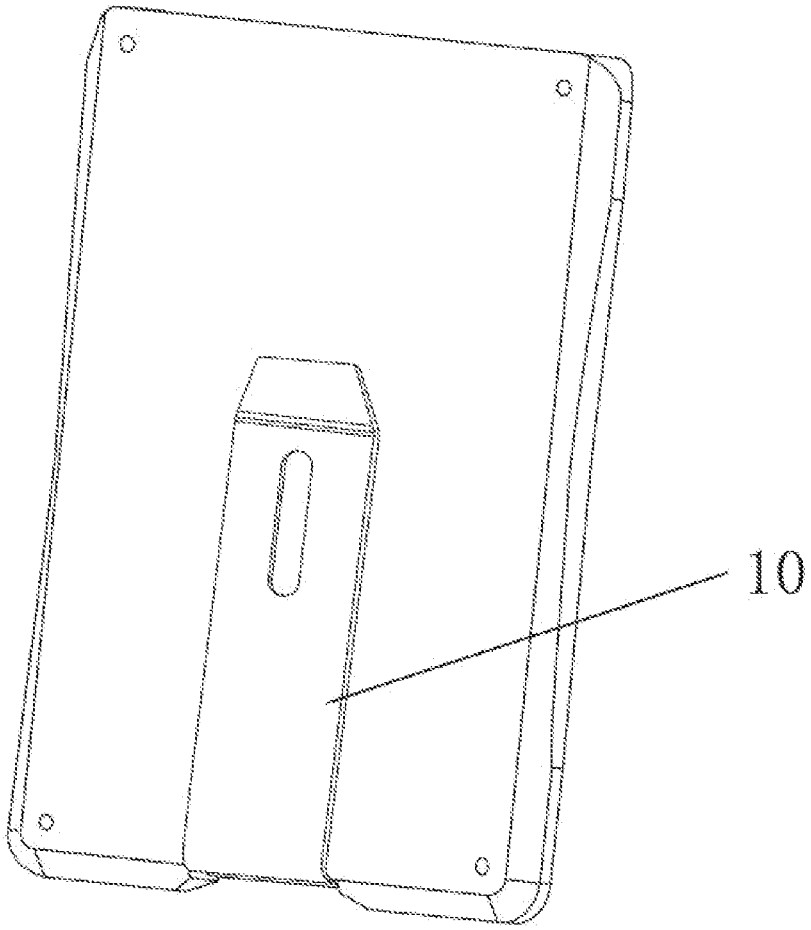
FIG. 11 is the structural schematic diagram for the back of FIG. 1.

Explanation to drawing sign: knockout plate 1, casing 2, baseplate 3, slide bar assembly 4, push rod 5, non-skid block 6, push column 7, iron sheet 8, magnet 9, clamp piece 10, concatenated board 1-2, lateral arm 2-1, bottom case 2-2, fixed block 2-3, slide block 4-1, slide bar 4-2, spring 4-3, rake face 5-1, push groove 5-2, sliding-groove 2-1-1, non-skid block slot 2-1-2, upper fixed groove 2-1-3, lower fixed groove 2-1-4, knockout plate slot 2-1-5, positive stop 2-2-1.

SPECIFIC EMBODIMENT OF THE INVENTION

Example 1

As shown in FIG. 1-11, the technical scheme adopted in this description of the preferred embodiments is: it includes knockout plate 1, casing 2 and baseplate 3, the knockout plate 1 is movably connected with the casing 2, the baseplate 3 and casing 2 are connected by screw, there is slide bar assembly 4 on the lateral wall of the said casing 2, elastic part(s) in existing technology is (are) mostly single stalk or two stalks of spring(s), which is (are) set at the bottom of the pushing mechanism, fixed column is mostly set at the bottom of pushing mechanism for fixing of spring, the spring hook at top of spring is fixed to the fixed column, not only single stalk of spring would produce unidirectional acting force in use, the pushing mechanism is prone to emergence of deviation to incur jamming, and the spring hook is prone to deformation and detaching after long time of use, but also two stalks of springs are also prone to deformation and detaching of spring hook, therefore, two groups of slide bar assemblies are adopted in the example, so as to avoid the problems that exist in existing structure;

The slide bar assembly 4 concretely includes the slide block 4-1, slide bar 4-2 and spring 4-3, the slide bar 4-2 penetrates the slide block 4-1, the spring 4-3 is belled to one end on the slide bar 4-2 for butting with the slide block 4-1, and the other end of it is butted with the casing 2, both ends of spring are constrained in this example, the spring is compressed instead of stretched when the slide block moves, the structure of spring would not be damaged, and the deformation of spring along the slide bar is constrained by the slide bar, it and slide block both move on the fixed track, so that circumstance of jamming would not occur at the knockout plate which also moves along the fixed track, thus the experience of using is greatly improved;

There is locating slot 1-1 at the lateral part of the said knockout plate 1, it is interlocked with the slide block 4-1, and when the slide block bites the locating slot, the moving of knockout plate can drive the slide block to move;

There is push rod 5 on the said baseplate 3, there is a segment of rake face 5-1 on that side of the said push rod 5 which is faced with the knockout plate 1, there is push groove 5-2 on the rake face 5-1, there is axle hole at the terminal of the push rod 5, and it is movably connected with the fixed axle at one end on bottom of the baseplate 3, the structure of push rod with rake face is shown in this example, by means of the rake face, the push rod can make the cards on it be layered when it rotates, so as to facilitate fetching of the needed card, and in the other example, there is progressive step structure on the rake face, and it can better push out cards in layers.

To describe more concretely, the said casing 2 includes lateral arm 2-1 and bottom case 2-2, there are two lateral arms 2-1, which (2-1) compose a U shaped opening structure together with the bottom case 2-2, the equipment body in this example is composed of three parts, the casing is the main carrier for card, the front (rear) knockout plate and baseplate compose the storage cavity, and the opening at top is used for putting in or fetching cards.

To describe more concretely, there is sliding-groove 2-1-1 at the middle up part of the said lateral arm 2-1, so as to match with the slide bar assembly 4, the slide bar assembly is put into the sliding-groove, the slide block matches with the sliding-groove and moves in it, and under the constraint of the sliding-groove, the travel is more accurate and deviation would not occur.

To describe more concretely, there is opening upper fixed groove 2-1-3 at the top of the said sliding-groove 2-1-1, there is opening lower fixed groove 2-1-4 at the bottom end of the sliding-groove 2-1-1, two places of fixed grooves are used for fixing the slide bar, and the planar end and the spring are butted for constraining the spring.

To describe more concretely, there is non-skid block slot 2-1-2 on the top part of the said lateral arm 2-1, there is fixed block 2-3 in the non-skid block slot 2-1-2, and the non-skid block 6 is interlocked on the fixed block 2-3, card is clamped by the non-skid block when it is put into the casing, the non-skid block would not excessively clamp card to affect the putting in and fetching of card, and there is installation groove that matches with the fixed block at the back of the non-skid block for plugging.

To describe more concretely, there is knockout plate slot 2-1-5 at the connection part of the said lateral arm 2-1 and the knockout plate 1, the said knockout plate 1 bilaterally extend outward to form the concatenated board 1-2, which (1-2) matches with the knockout plate slot 2-1-5, and through the plugging engagement of concatenated board and the knockout plate slot, the knockout plate can perform ascending and descending movement in the casing.

To describe more concretely, there is positive stop 2-2-1 at the middle part of the said bottom case 2-2, there is gap at that end of the positive stop 2-2-1 close to the knockout plate 1, the positive stop is butted with the undersurface of the push rod, so as to retain the bottom part of the push rod;

Bottom of the bottom case 2-2 is connected with a clamp piece 10 by screw, and the clamp piece 10 contacts the baseplate 3 after bending upward, a clamp piece slot is opened at that position on bottom case which corresponds to the clamp piece, so as to match with the fixed end of the clamp piece, so that after the clamp piece is installed, it is flush to the bottom of the bottom case, the integral effect is better, it would not protrude from the plane to affect normal operation of fetching card, since the clamp piece has elasticity in daily use, some papers or unnecessary cards can be clamped into it as temporary storage position for use, so as to enrich the integral function of the storage box, and improve its using convenience and practicality.

To describe more concretely, there is push column 7 at the bottom center of the said knockout plate 1, the push column is movably connected with the push groove, when the knockout plate moves, the push column moves in the push groove to drive the rotation of push rod, so as to realize layered pushing of cards.

Example 2

Figure 12:
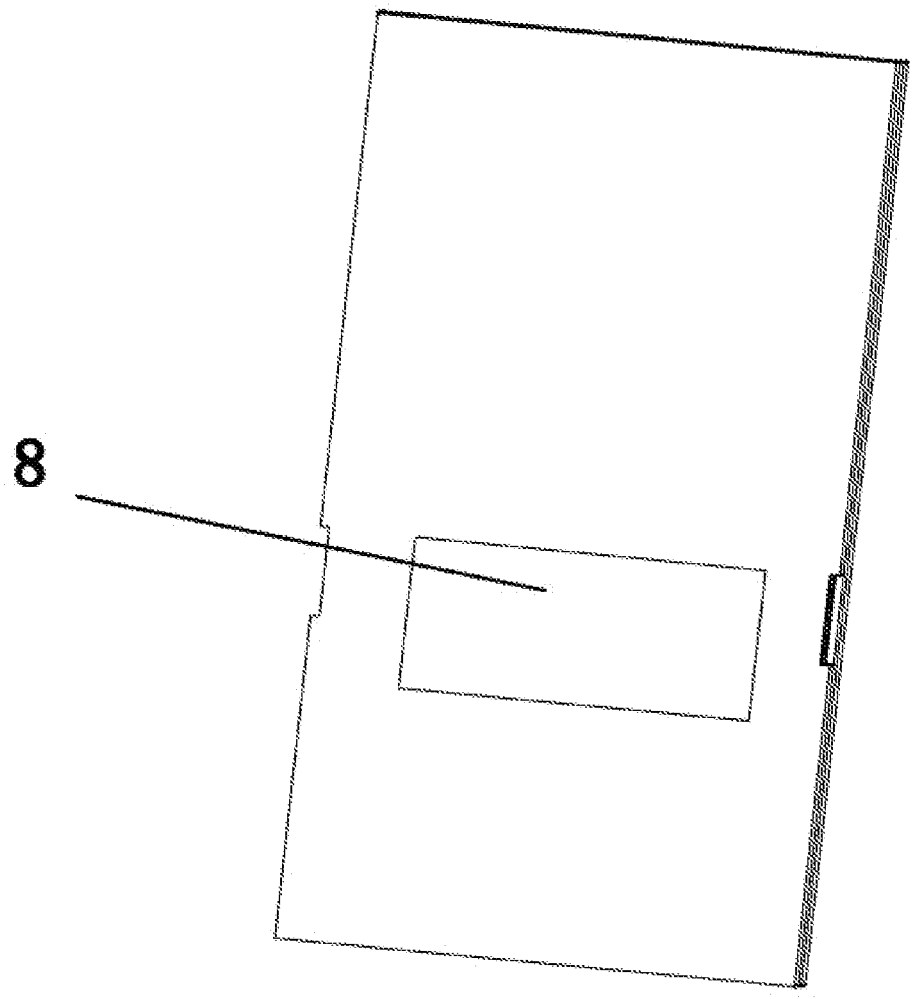
FIG. 12 is the structural schematic diagram for the knockout plate 1 in the description of the preferred embodiments 2.
Figure 13:
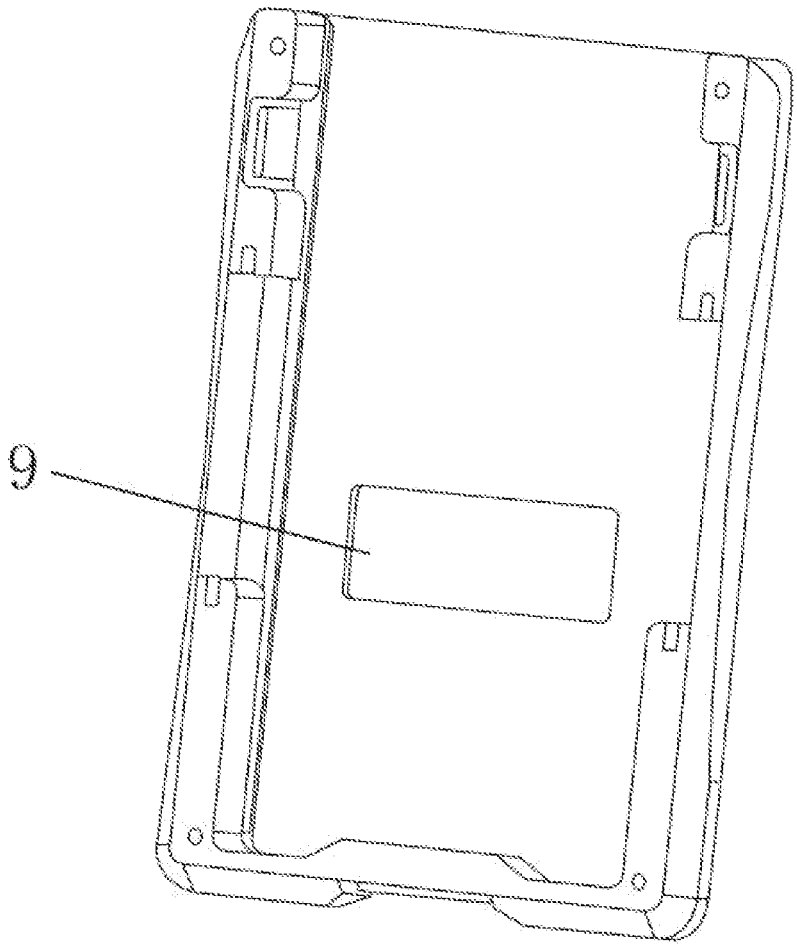
FIG. 13 is the structural schematic diagram for the baseplate 3 in the description of the preferred embodiments 2.

As shown in FIG. 12-13, this example differs from example 1 in that: there is iron sheet 8 at that side of the said knockout plate 1 which is faced with the baseplate 3, there is magnet 9 on the baseplate 3, other structure and connection mode are identical to those of example 1, the iron sheet 8 is located at the initial position of the slide block 4-1, the magnet 9 is also located at the initial position of the slide block 4-1, when it is not used, the iron sheet 8 and the low position magnet 9 mutually attract, so as to further prevent random displacement of the knockout plate 1, when the knockout plate 1 is pushed for fetching card, it can concurrently acquire the resetting acting force of the spring and the magnet, so it has better resetting effect and feel, and the using experience is effectively improved.

After the above technical scheme is adopted, the advantageous effect of this industrial new design is: 1. Bilateral elastic slide bar assembly is adopted, steady and smooth restoration acting force can be provided, so that the knockout plate can stably move without jamming in both pushing out and resetting;

2. In the mode of driving the spring to move by the slide block, the spring is not stretched, the service life of the spring is prolonged, meanwhile, the feel of using is better and the using experience of user is improved.

The above contents are merely used for describing the technical scheme of this industrial new design instead of its constraint, and for ordinary technical personnel in this field, in case of other modification or equivalent substitution to this industrial new design by them, so long as it is not far from the spirit and scope of the technical scheme of this industrial new design, it should be included in the claim scope of this industrial new design.

The invention claimed is:

1. A card storage box with a slide bar structure, comprising: a pushing plate (1), a casing (2) and a baseplate (3), the pushing plate (1) being movably connected to the casing (2), the baseplate (3) being connected to the casing (2) by screws, a slide bar assembly (4) provided on a lateral wall of the casing (2), the slide bar assembly (4) including a slide block (4-1), a slide bar (4-2) and a spring (4-3), the slide bar (4-2) penetrating the slide block (4-1), the spring (4-3) being sleeved on the slide bar (4-2), one end of the spring (4-3) abutting the slide block (4-1), and the other end abutting the casing (2), a locating slot (1-1) provided on a lateral side of the pushing plate (1) and interlocked with the slide block (4-1), and a push rod (5) provided on the baseplate (3).

2. The card storage box according to claim 1, wherein: the casing (2) includes two lateral arms (2-1) and a bottom case (2-2), the two lateral arms (2-1) and the bottom case (2-2) forming a U shaped opening structure (2-2), and a sliding-groove (2-1-1) is provided at a middle upper portion of each of the lateral arms (2-1) for cooperating with the slide bar assembly (4).

3. The card storage box according to claim 2, wherein: an upper fixing groove (2-1-3) having an opening is provided at a top end of the sliding groove (2-1-1), and a lower fixing groove (2-1-4) having an opening is provided at a bottom end of the sliding groove (2-1-1).

4. The card storage box according to claim 2, wherein: a non-skid block slot (2-1-2) is provided at a top of each lateral arm (2-1), a fixed block (2-3) is provided in the non-skid block slot (2-1-2), and a non-skid block (6) is clamped on the fixed block (2-3).

5. The card storage box according to claim 2, wherein: a pushing plate slot (2-1-5) is provided at a connection between each lateral arm (2-1) and the pushing plate (1).

6. The card storage box according to claim 1, wherein: the pushing plate (1) extends outward on both sides to form connection plates (1-2), and the connection plates (1-2) cooperate with the pushing plate slot (2-1-5).

7. The card storage box according to claim 2, wherein: a stop (2-2-1) is provided at the middle part of the bottom case (2-2), a gap is provided between the stop (2-2-1) and a side of the pushing plate (1), the bottom of the bottom case (2-2) is connected with a clamp piece (10) by screws, and the clamp piece (10) is bent upward and contacts the baseplate (3).

8. The card storage box according to claim 1, wherein: an inclined surface (5-1) is provided on a side of the push rod (5) facing the pushing plate (1), a pushing groove (5-2) is provided on the inclined face (5-1), and a shaft hole is provided at an end of the push rod (5), and is movably connected with a fixed shaft at a bottom side of the baseplate (3).

9. The card storage box according to claim 1, wherein: a pushing column (7) is provided at a bottom center of the pushing plate (1).

10. The card storage box according to claim 1, wherein: an iron sheet (8) is provided on a side of the pushing plate (1) facing the baseplate (3), and a magnet (9) is provided on the baseplate (3).

* * * * *